US011498824B2

(12) United States Patent
Zemko

(10) Patent No.: US 11,498,824 B2
(45) Date of Patent: Nov. 15, 2022

(54) MIXED BEVERAGE DISPENSERS AND SYSTEMS AND METHODS THEREOF

(71) Applicant: Marmon Foodservice Technologies, Inc., Osseo, MN (US)

(72) Inventor: Christopher F. Zemko, Elgin, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 17/088,210

(22) Filed: Nov. 3, 2020

(65) Prior Publication Data

US 2021/0130148 A1 May 6, 2021

Related U.S. Application Data

(60) Provisional application No. 62/930,264, filed on Nov. 4, 2019.

(51) Int. Cl.
*B67D 1/00* (2006.01)

(52) U.S. Cl.
CPC ..... *B67D 1/0027* (2013.01); *B67D 1/004* (2013.01)

(58) Field of Classification Search
CPC .... B67D 1/0027; B67D 1/004; B67D 1/0044; B67D 1/005; B67D 1/1295; B67D 1/0037; B67D 1/1218; B67D 1/0085
USPC ..... 222/129.1, 129.4, 504, 54, 23, 1
See application file for complete search history.

(56) References Cited

U.S. PATENT DOCUMENTS 2,566,436 A 9/1951 Waite
2,620,108 A 12/1952 Copping
3,272,388 A 9/1966 Whitmore
3,575,352 A 4/1971 Hall et al.
3,744,764 A 7/1973 Sedam
4,201,558 A 5/1980 Schwitters et al.
4,203,461 A 5/1980 Schwitters
(Continued)

FOREIGN PATENT DOCUMENTS

WO 2007070031 6/2007
WO 2009014850 1/2009
(Continued)

OTHER PUBLICATIONS

The International Search Report and Written Opinion for PCT/US2020/058717, dated Feb. 5, 2021.

*Primary Examiner* — Charles P. Cheyney
(74) *Attorney, Agent, or Firm* — Andrus Intellectual Property Law, LLP

(57) ABSTRACT

A beverage dispenser includes a source of a base fluid, a source of a concentrate, and an assembly configured to receive and dispense the base fluid and the concentrate together as a mixed beverage having a predetermined base fluid-to-concentrate ratio. An actuator is configured to control flow of the base fluid and the concentrate to the assembly. The assembly is configured to premix a first portion of the base fluid with the concentrate to form a premixed concentrate, and to then dispense a combination of the premixed concentrate and a second portion of the base fluid as the mixed beverage having the predetermined base fluid-to-concentrate ratio. The actuation of the actuator causes an uninterrupted dispense of the base fluid and the concentrate from the source of the base fluid and the source of the concentrate, respectively, to the assembly, and from the assembly to a consumer of the mixed beverage.

19 Claims, 5 Drawing Sheets

(56) References Cited

U.S. PATENT DOCUMENTS 4,509,690 A 4/1985 Austin et al.
4,708,266 A 11/1987 Rudick
4,793,520 A 12/1988 Gerber
4,986,447 A 1/1991 McCann et al.
5,011,043 A * 4/1991 Whigham ..... B67D 1/0037 222/129.3
5,035,121 A 7/1991 Cook
5,048,726 A 9/1991 McCann et al.
5,129,549 A 7/1992 Austin
5,203,474 A * 4/1993 Haynes ..... B67D 1/005 222/129.1
5,269,442 A 12/1993 Vogel
5,285,815 A 2/1994 Henry et al.
5,368,198 A 11/1994 Goulet
5,415,326 A 5/1995 Durham et al.
5,535,600 A 7/1996 Mills
5,570,822 A 11/1996 LeMarbe et al.
5,607,083 A 3/1997 Vogel et al.
5,738,248 A 4/1998 Green
5,758,571 A 6/1998 Kateman et al.
5,792,391 A 8/1998 Vogel et al.
5,845,815 A 12/1998 Vogel
5,901,884 A 5/1999 Goulet et al.
6,047,859 A 4/2000 Schroeder et al.
6,095,371 A 8/2000 Mooney
6,220,047 B1 4/2001 Vogel et al.
6,223,948 B1 5/2001 Davis
6,253,963 B1 7/2001 Tachibana
6,689,410 B2 2/2004 Gerber
6,808,091 B2 10/2004 Njaastad
6,871,761 B2 3/2005 Fox
6,915,732 B2 7/2005 Jones et al.
6,962,270 B1 * 11/2005 Barker ..... G05D 11/132 222/129.4
7,059,761 B2 6/2006 Gerber
7,070,068 B2 7/2006 Fox
7,077,290 B2 * 7/2006 Bethuy ..... B67D 1/0032 222/129.1
7,108,156 B2 9/2006 Fox
7,383,966 B2 6/2008 Ziesel
7,445,133 B2 11/2008 Ludovissie et al.
7,487,887 B2 2/2009 Ziesel
7,578,415 B2 8/2009 Ziesel
7,665,632 B2 2/2010 Ziesel
7,717,297 B2 5/2010 Kadyk et al.
7,866,509 B2 1/2011 Ziesel
7,913,878 B1 3/2011 Baron et al.
8,047,402 B2 11/2011 Ziesel
8,087,544 B2 * 1/2012 Elsom ..... B67D 1/0031 222/57
8,091,737 B2 1/2012 Smeller et al.
8,162,177 B2 4/2012 Ziesel
8,181,824 B2 5/2012 Ziesel et al.
8,328,050 B2 12/2012 Ziesel
8,403,179 B1 3/2013 Gerber
8,453,879 B2 6/2013 Carpenter et al.
8,511,516 B2 8/2013 Klopfenstein et al.
8,567,642 B2 10/2013 Hoover
8,701,937 B2 4/2014 Hoover
8,807,392 B2 8/2014 Smeller
8,820,580 B2 9/2014 Ziesel
8,960,500 B2 2/2015 Van Opstal et al.
8,985,396 B2 3/2015 Jersey et al.
9,010,577 B2 4/2015 Hoover
9,010,580 B2 4/2015 Rolek
9,131,709 B2 9/2015 Hammonds et al.
9,593,005 B2 3/2017 Jersey et al.
9,656,849 B2 5/2017 Hawken
10,138,107 B2 11/2018 Zemko et al.
2001/0011660 A1 8/2001 Schroeder et al.
2002/0170925 A1 11/2002 Friedman
2003/0015551 A1 * 1/2003 Henry ..... B67D 1/005 222/129.3
2003/0161923 A1 8/2003 Holland et al.
2003/0216832 A1 11/2003 Sudolcan
2005/0045655 A1 3/2005 Santy
2005/0051577 A1 3/2005 Loeb et al.
2005/0067433 A1 3/2005 Brandt et al.
2007/0267441 A1 11/2007 Van Opstal et al.
2008/0073376 A1 3/2008 Gist et al.
2008/0282724 A1 11/2008 Minard et al.
2009/0014464 A1 * 1/2009 Adbelmoteleb ..... B67D 1/07 222/1
2009/0230149 A1 9/2009 Smeller et al.
2010/0014875 A1 6/2010 Santos et al.
2012/0046785 A1 * 2/2012 Deo ..... B67D 1/108 700/231
2013/0200103 A1 * 8/2013 Gates ..... B67D 7/74 222/145.5
2014/0092705 A1 4/2014 Riel
2014/0209629 A1 * 7/2014 Gates ..... B67D 1/0044 222/1
2014/0263414 A1 9/2014 San Miguel et al.
2014/0361041 A1 12/2014 Hawken
2015/0315006 A1 11/2015 Ziesel
2015/0335208 A1 11/2015 Ciavarella et al.
2016/0009539 A1 1/2016 Jersey et al.
2016/0229675 A1 8/2016 Popov et al.
2018/0126427 A1 5/2018 Haselwood et al.
2018/0162710 A1 6/2018 Moore et al.
2019/0039873 A1 2/2019 Aslam et al.

FOREIGN PATENT DOCUMENTS

WO 2014036098 3/2014
WO 2017087383 5/2017
WO 2018064454 4/2018

* cited by examiner

MIXED BEVERAGE DISPENSERS AND SYSTEMS AND METHODS THEREOF

CROSS-REFERENCE TO RELATED APPLICATION

The present disclosure is based on and claims priority to U.S. Provisional Patent Application No. 62/930,264 filed Nov. 4, 2019, the disclosure of which is incorporated herein by reference.

FIELD

The present disclosure generally relates to beverage dispensers for dispensing mixed beverages to operators.

BACKGROUND

The following U.S. Patents are incorporated herein by reference in entirety.

U.S. Pat. No. 4,509,690 discloses a mixing nozzle for a post-mix beverage dispenser having a water supply chamber co-axially surrounding a syrup supply port, an elongate syrup diffuser having a spray head on its lower end, an upper water distribution disc on the diffuser having a plurality of apertures having a cumulative opening area for passage of water, a convex frusto-conical water spreader is directly below the upper disc, and a lower water distribution disc is spaced below the upper disc and the spreader.

U.S. Pat. No. 5,035,121 discloses an agitating and pumping device for use with a beverage cooling and dispensing ice-bank system. The ice-bank includes a reservoir for holding water and refrigerating coils therein for cooling the water. A heat exchange circuit is in heat exchange relationship with the reservoir water for cooling beverage circulated there through.

U.S. Pat. No. 5,129,549 discloses a beverage dispensing valve having a valve body that will accept beverage flow controls, water and syrup valves that are interchangeable in either of two fluid ports, a reversible block between the valves and a nozzle that enables syrup to be used in either port and water to be used in either port, a positively sealing and easily removable nozzle for improved sanitation and mixing, and multiple fulcrums in the valve body that will respectively accept a manual actuator or a switch actuator and a solenoid driven actuator.

U.S. Pat. No. 5,269,442 discloses a nozzle for a post-mix beverage dispensing valve that optimizes flow of fluids. The nozzle includes a first diffuser plate followed by a central flow piece having a frusto-conical outer water flow surface and an interior syrup flow channel. Second and third diffuser plates follow the frusto-conical portion. The second and third diffuser plates have perimeter edges that contact the inner surface of a nozzle housing so that the carbonated water must flow through holes in the diffusers.

U.S. Pat. No. 5,285,815 discloses a post-mix beverage dispensing valve having a quick disconnect mounting and easily detachable valve cover housing and valve actuating lever. The quick disconnect includes a body having a pair of parallel shafts extending there through.

U.S. Pat. No. 5,368,198 discloses a beverage dispenser having a flat carbonator along one end of an ice bank cooled water bath tank. A plurality of syrup coils are arranged along an interior surface of the carbonator. An evaporator extends around a central perimeter of the water bath tank creating a central opening through which an agitator shaft and blade extend for operation by an agitator motor.

U.S. Pat. No. 5,535,600 discloses a cooling system for post-mix beverage dispenser including an ice bath tank for holding a liquid, a refrigeration circuit for cooling the liquid in the ice bath tank, a concentrate storage area, and a cooling circuit coupled to the ice bath tank, for cooling the concentrate storage area. A pump in the cooling circuit transfers the liquid from the ice bath tank to a coil in the concentrate storage container. The circuit returns the liquid to the ice bath tank and creates the turbulence necessary for the liquid to freeze evenly in the tank.

U.S. Pat. No. 5,607,083 discloses a post-mix beverage dispensing valve having a nozzle that provides for higher flow rates. The valve is designed to provide for an electronic switch/control module separate from the valve housing cover, and the valve includes improved banjo valves and accompanying seat structures providing for increased fluid flow and for fluid flow that is less turbulent.

U.S. Pat. No. 5,792,391 discloses a carbonator having a tube cylinder with a closed end and an open end. A disk is removably retained in the open end for providing access into the interior volume thereof. The disk provides for mounting thereto of water and carbon dioxide gas inlets, a carbonated water outlet, a safety relief valve, and a water level sensor.

U.S. Pat. No. 5,845,815 discloses a piston based flow control for use in a high flow beverage dispensing valve. The piston includes a top perimeter edge structure that allows for continuity of fluid flow during high flow applications and particularly during the initiation of a high flow dispensing so as to eliminate chattering of the piston.

U.S. Pat. No. 5,901,884 discloses a beverage dispenser that includes an outer housing having a water bath tank therein and a refrigeration retaining component area therein positioned directly adjacent and next to the water bath tank. A refrigeration chassis provides for retention and carrying of a refrigeration system including a compressor, a condenser and powered cooling fan and an evaporator.

U.S. Pat. No. 9,010,577 discloses a fountain beverage dispenser for constituting a beverage by mixture of a beverage syrup and a diluent for the syrup by use of a highly concentrated beverage syrup supply and at least one diluent and syrup blending station for diluting the highly concentrated syrup with diluent before the diluted syrup is mixed with diluent in the final mixture of syrup and diluent delivered to a dispensing nozzle.

U.S. Patent Application Publication No. 2019/0039873 discloses an insert for use with a beverage dispenser. The insert has an upstream end configured to receive the first base fluid, a downstream end with an outlet configured to dispense the first base fluid, and a center bore extending between the upstream end and the downstream end along an axis. A stem is disposed in the center bore of the diffuser and has a first end configured to receive a second base fluid and an opposite second end with an outlet configured to dispense the second base fluid.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to an example of the present disclosure, a beverage dispenser includes a source of a base fluid, a source of a concentrate, and an assembly configured to receive and dispense the base fluid and the concentrate together as a mixed beverage having a predetermined base fluid-to-concentrate ratio. An actuator is configured to control flow of the base fluid and the concentrate to the assembly. The assembly is configured to premix a first portion of the base fluid with the concentrate to form a premixed concentrate, and to then dispense a combination of the premixed concentrate and a second portion of the base fluid as the mixed beverage having the predetermined base fluid-to-concentrate ratio. The actuation of the actuator causes an uninterrupted dispense of the base fluid and the concentrate from the source of the base fluid and the source of the concentrate, respectively, to the assembly, and from the assembly to a consumer of the mixed beverage.

According to an example of the present disclosure, a method of dispensing a mixed beverage having a predetermined base fluid-to-concentrate ratio includes dispensing an uninterrupted flow of a base fluid and a concentrate to an assembly, which in real-time during dispense of the mixed beverage to the consumer, premixes a first portion of a base fluid with the concentrate to form a premixed concentrate, and then mixes a second portion of the base fluid with the premixed concentrate to form the mixed beverage.

Various other features, objects, and advantages will be made apparent from the following description taken together with the drawings.

BRIEF DESCRIPTION OF THE DRAWINGS

The present disclosure includes the following Figures. The same numbers are used throughout the Figures to reference like features and like components.

DETAILED DESCRIPTION

Figure 1:
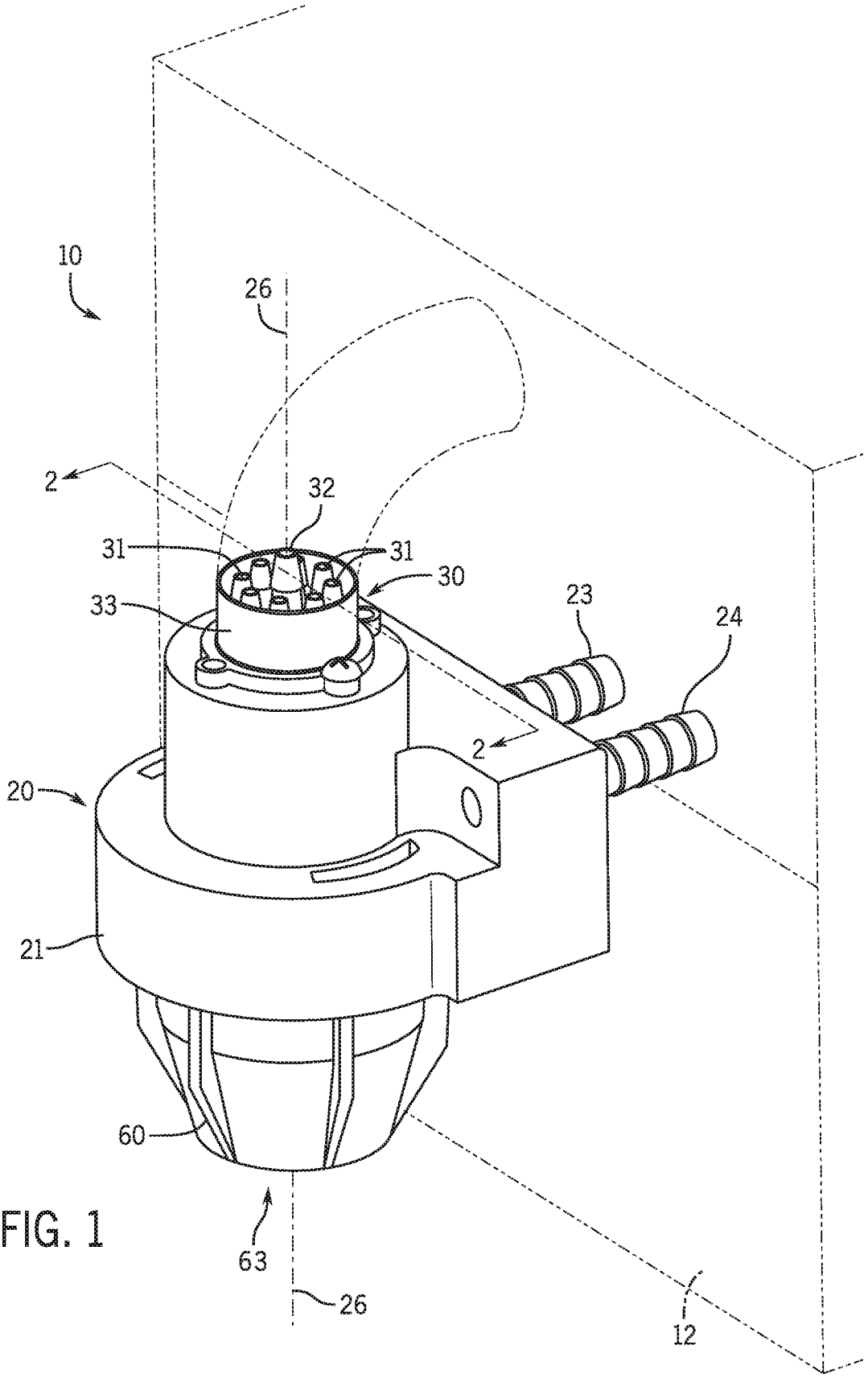
FIG. 1 is a perspective view of an example dispenser and assembly of the present disclosure.

The present disclosure generally relates to dispensers for dispensing mixed beverages to an operator. Known dispensers dispense a diluent or base fluid (e.g., carbonated water) and one or more concentrates (e.g., soda syrup concentrate) that mix together and thereby form a desired mixed beverage. The fluids are often dispensed into a receptacle (e.g., cup) such that the operator can consume the mixed beverage. The type of mixed beverage depends on the type and/or volume of the base fluid and the concentrate(s) that the dispenser dispenses.

The dispenser dispenses different types of base fluids and/or concentrates such that different mixed beverages are formed. The dispenser can dispense low ratio concentrate(s) and/or high ratio concentrate(s). In one example, the dispenser dispenses low ratio concentrates with a base fluid such that the fluid ratio (e.g., parts base fluid to parts low ratio concentrate) of the mixed beverage is less than or equal to 5:1 (e.g., 1:1, 2:1, 3:1, 4:1.25). A specific example of a mixed beverage formed with a low ratio concentrate is cola soda formed from carbonated water and cola concentrate syrup. In another example, the dispenser dispenses high ratio concentrates with a base fluid such that the fluid ratio of the mixed beverage is greater than 5:1 (e.g., 8:1, 20:1, 50:1, 100:1, and 200:1). A specific example of a mixed beverage formed with one high ratio concentrate is carbonated water enriched with a vitamin syrup. A specific example of a mixed beverage formed with two high ratio concentrates is carbonated water mixed with lemon flavor syrup and concentrated caffeine fluid. Note that certain dispensers of the present disclosure can dispense both low ratio concentrate(s) and high ratio concentrate(s). Examples of high ratio concentrates include flavor additive syrups (e.g., lime flavor syrup, cherry flavor syrup, coffee flavor syrup) and nutrient fluids (e.g., vitamin C fluid, electrolyte fluid, caffeine fluid).

The present inventor recognized that dispensing high ratio concentrates from known dispensers presents operational challenges due to the fluid characteristics, such as viscosity and sugar content, of the high ratio concentrates. For example, high ratio concentrates may not flow through the dispenser as quickly as low ratio concentrates. Furthermore, residual amounts of the high ratio concentrates may remain on (e.g., stick to) surfaces within the dispenser. Therefore, these residual amounts of high ratio concentrate may disadvantageously "carry over" into subsequently dispensed mixed beverages thereby contaminating these mixed beverages.

The present inventor endeavored to solve or minimize problems associated with dispensers that dispense high ratio concentrates, and through research and experimentation, the present inventor developed the dispensers of the present disclosure (detailed herein below). Generally, the present inventor determined it would be advantageous to "premix" the concentrate(s) (e.g., high ratio concentrates) with an amount or portion of the base fluid to form a premixed or diluted concentrate before mixing, and further diluting, the premixed concentrate with the remaining amount or portion of the base fluid. The two-stage dilution of the concentrate(s) advantageously occurs as the base fluid and the concentrate(s) are being dispensed to form the mixed beverage (e.g., the concentrate(s) are diluted and further mixed with the base fluid in real-time during dispense of the mixed beverage). As such, the dispenser does not hold or store premixed concentrate(s) within the dispenser for subsequent mixed beverages and the types and/or number of concentrate(s) which can be diluted can change such that different mixed beverages can be formed. The premixed concentrate flows more easily and faster through the dispenser (in comparison to high ratio concentrates flowing through known dispensers) and subsequently mixes with additional amounts the base fluid such that the desired mixed beverage is properly formed at a predetermined base fluid-to-concentrate fluid ratio. Furthermore, the present inventor determined that diluting the concentrate(s) reduces the residual amounts of the concentrate(s) that would normally remain in the dispenser and "carry over" to subsequently dispensed mixed beverages. Examples dispensers of the present disclosure are further described hereinbelow.

FIG. 1 depicts an example mixed beverage dispenser 10 for dispensing one or more mixed beverages to an operator. The dispenser 10 includes a cabinet 12 (depicted in dashed lines) that conceals internal components of the dispenser 10, such as known refrigeration system components, electronics, pumps, valves, manifolds, fluid lines, and the like. Reference is made to the above-incorporated U.S. Patents for examples of beverage dispensers and components thereof. The dispenser 10 can include or be coupled to one or more base fluid sources 71, 72 (FIG. 3), such as pressurized water tanks and carbonators, and one or more concentrate sources 73 (FIG. 3), such as bag-in-box containers or plastic concentrate jugs.

The example dispenser 10 described herein below is configured to receive two base fluids (e.g., plain water and carbonated water) and a plurality of low-ratio concentrates (e.g., soda syrup flavor) and/or high ratio concentrates (e.g., flavor syrup, cherry flavor syrup, coffee flavor syrup). The dispenser 10 dispenses the base fluid(s) and the concentrate(s) such that the fluids mix and thereby form a desired mixed beverage (described in greater detail herein below). Note that the example dispenser 10 can be configured receive and dispense any number of base fluids, low-ratio concentrates, and/or low-ratio concentrates. Note that in one example the fluids mix within the dispenser (e.g., the fluids mix within a nozzle and the dispenser dispenses the mixed beverage), and in another example the fluids mix together downstream of the dispenser (e.g., the fluids mix together within a cup).

Figure 2:
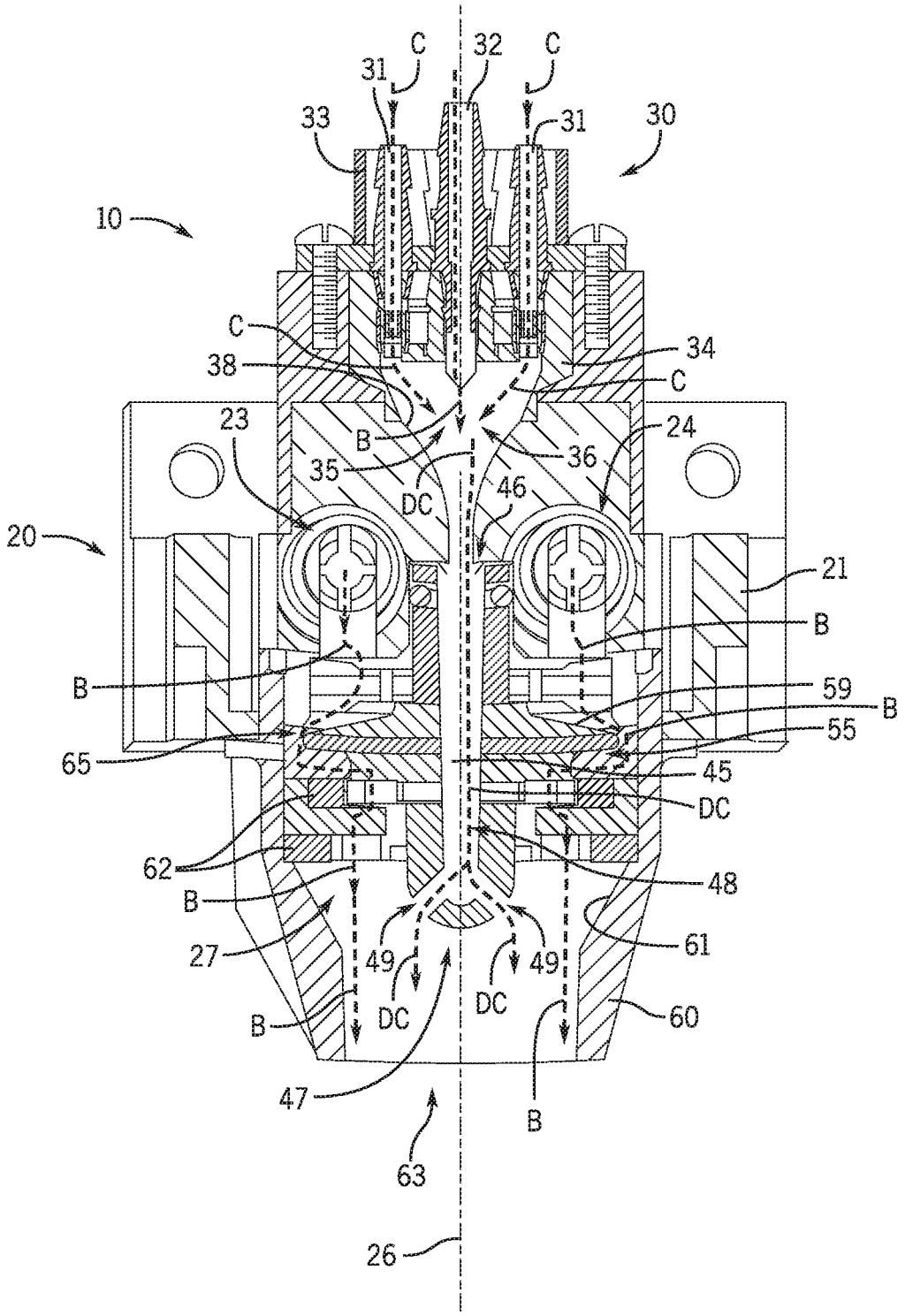
FIG. 2 is a cross-sectional view of the assembly of FIG. 1 along line 2-2 on FIG. 1.
Figure 3:
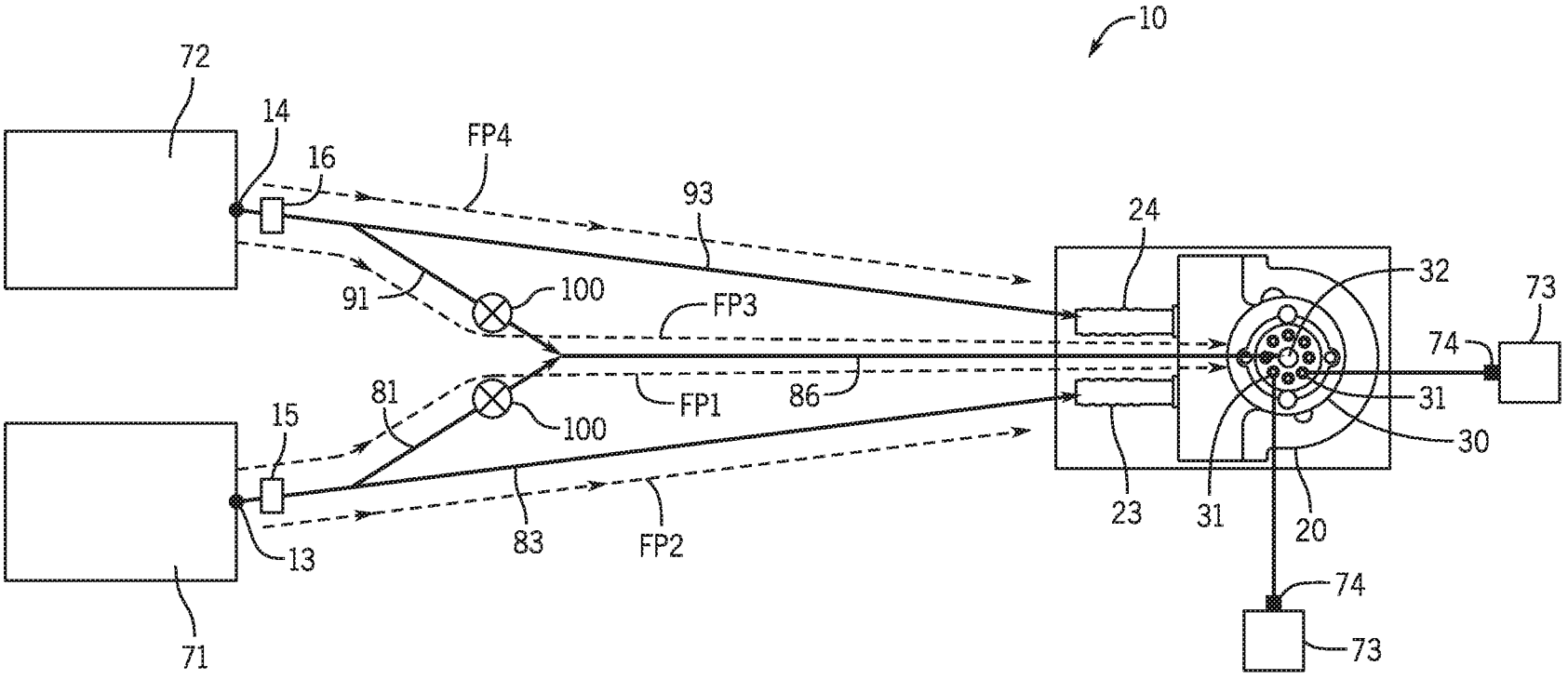
FIG. 3 is a schematic diagram of an example dispenser of the present disclosure.

Referring to FIG. 2, the dispenser 10 includes an assembly 20 coupled to the cabinet 12 (FIG. 1) that receives the base fluids from the base fluid sources 71, 72 and the concentrates from the concentrate sources 73 (FIG. 3). The assembly 20 extends along an axis 26 and includes a concentrate manifold 30 and a body 21 downstream from the manifold 30. The assembly 20 also includes a removable nozzle 60 coupled to the downstream end of the body 21. The manifold 30, the body 21, and the nozzle 60 are each centered on the axis 26. Each of these components are described in greater detail hereinbelow. Note that in the example depicted in FIG. 2, the concentrate manifold 30, the body 21, and the nozzle 60 are in a vertically stacked configuration relative to each other. Note that FIG. 2 depicts the flow of different fluids through the assembly 20 as dashed lines (e.g., dashed line C is a concentrate, dashed line B is a base fluid, dashed line DC is a premixed concentrate).

The concentrate manifold 30 has a plurality of concentrate inlets 31 that receive the concentrates from the concentrate sources 73 (FIG. 3). The manifold 30 can include any number of concentrate inlets 31. For example, the manifold 30 depicted in FIG. 1 has eight concentrate inlets 31. The manifold 30 also has a manifold inlet 32 that receives a base fluid, such as plain water or carbonated water. Note that the inlets 31, 32 are depicted as barbed fittings. In certain examples, valves (e.g., duckbill valves) are provided at each inlet 31, 32 to prevent fluids in the assembly 20 from backflowing to the base concentrate sources 73 and base fluid sources 71, 72, respectively. An example conventional duck valve is commercially available from MiniValve (model/part #DO 047.001 SD). In some examples, one or more concentrate inlets 31 may receive low ratio concentrates and thus, the dispenser 10 can dispense low ratio concentrates and/or high ratio concentrates.

The manifold 30 has a cover 33 removably coupled to the body 21 and a flexible membrane 34 sandwiched between the cover 33 and the body 21. The flexible membrane 34 is for receiving and holding the inlets 31, 32 in the manifold 30. The fluids received via the inlets 31, 32 flow into a chamber 36 defined by a sidewall 38 of the flexible membrane 34. The sidewall 38 is configured to radially inwardly direct fluids (e.g., the concentrates) such that the fluids flowing through the manifold 30 mix with each other. The sidewall 38 also directs the fluids toward a manifold outlet 35. Note that the fluids flow through the chamber 36 under force of gravity and/or upstream fluid pressure. As will be described in greater detail herein below, the concentrates flowing through the concentrate inlets 31 into the chamber 36 are initially diluted or mixed with the base fluid flowing through the manifold inlet 32 into the chamber 36 such that the base fluid and the concentrates mix and form a premixed concentrate that flows through the manifold outlet 35 to a downstream hollow stem 45.

The stem 45 extends along the axis 26 and is positioned in an internal cavity 27 defined by the body 21 and the nozzle 60 (described hereinbelow). The stem 45 has an upstream first stem end 46, a downstream second stem end 47, and a bore 48 that extends between the stem ends 46, 47. The first stem end 46 receives the premixed concentrate from the manifold outlet 35 (described above), and the second stem end 47 has one or more ports 49 through which the premixed concentrate dispenses into the cavity 27. In one example, the ports 49 radially outwardly direct the premixed concentrate toward an interior surface 61 of the nozzle 60 (described hereinbelow). In certain examples, the premixed concentrate flows from the ports 49 in the form of streams such that the premixed concentrate evenly mixes with the base fluid that flows through a diffuser 55 (described hereinbelow).

The diffuser 55 in the cavity 27 encircles the stem 45, and one or more base fluids received via body inlets coupled to body 21 flow through the diffuser 55. In this example, a pair of body inlets receive two base fluids. That is, a first body inlet 23 receives a first base fluid (e.g., plain water) and a second body inlet 24 receives a second base fluid (e.g., carbonated water) (see also FIG. 1). Note that the body inlets 23, 24 are depicted as barbed fittings. In certain examples, valves (e.g., duckbill valves) are provided at each body inlet 23, 24 to prevent fluids in the assembly 20 from backflowing to the base fluid sources 71, 72. Note that the diffuser 55 defines a center bore (not shown) in which the stem 45 extends. The center bore and the stem 45 extend along the axis 26.

The base fluid(s) received via the body inlets 23, 24, flow downstream through the cavity 27 under force of gravity and/or upstream fluid pressure. A radially outwardly sloped surface 59 of the diffuser 55 radially outwardly deflects the base fluid(s) toward an annular gap 65 defined between the sloped surface 59 and the interior surface 61 of the nozzle 60. The base fluid(s) flow through the annular gap 65 and pass through holes defined in one or more porous plates 62 of the diffuser 55. The plates 62 are positioned downstream from the sloped surface 59. The sloped surface 59 and the plates 62 advantageously distribute or spread the flow of the base fluid through the cavity 27. In addition, when the base fluid flowing through cavity 27 is carbonated water, the plates 62 and the sloped surface 59 advantageously reduce "break out" of carbon dioxide from carbonated water as the carbonated water flows downstream. Reference is made to above incorporated U.S. Patent Application Publication No. 2019/0039873 for an example of known diffusers and stems (and features thereof) that may be incorporated into the dispenser 10 of the present disclosure.

After the base fluid flows through the holes in the plates 62, the base fluid mixes with the premixed concentrate flowing from the ports 49 of the stem 45 and the fluids (the premixed concentrate and the base fluid from the diffuser 55) dispense through a nozzle outlet 63 of the nozzle 60 to an operator. The nozzle 60 is removably coupled to the body 21 such that the nozzle 60 can be periodically removed and cleaned.

The dispenser 10 controls the flow rates of the fluids such that the mixed beverage is properly formed at a predetermined base fluid-to-concentrate fluid ratio. For example, the dispenser 10 is configured to dispense the concentrate(s) and the base fluid(s) at predetermined flow rates according to a selected mixed beverage recipe. As such, the fluids mix and form the mixed beverage at the predetermined fluid ratio. No additional diluents need be mixed with the mixed beverage. For instance, the dispenser dispenses the fluids at a combined flow rate of 1.05 ounces per second (oz/sec). This combined flow rate comprises a predetermined base fluid flow rate of 1.00 oz/sec and a predetermined concentrate(s) flow rate of 0.05 oz/sec. Accordingly, the fluids combine to form a mixed beverage having a predetermined fluid ratio of 20:1. A person of ordinary skill in the art will recognize that if the actual flow rates of the base fluid and/or concentrate(s) are different than the predetermined flow rates prescribed by the selected recipe or additional diluents are mixed in the mixed beverage, the mixed beverage would be improperly formed (e.g., the improperly formed mixed beverage has a fluid ratio that is different than the predetermined fluid ratio). Note that any suitable devices can be used to control the flow of the base fluids and the concentrate(s) (e.g., valves, adjustable orifice devices, outlet devices on carbonators, pumps).

The present inventor endeavored to develop dispensers that dilute the concentrate(s) (as described above) while still accurately dispensing the selected base fluid(s) and the concentrate(s) that mix to form the desired mixed beverage. To accomplish these goals, the present inventor discovered it is advantageous to divide or split the flow of the selected base fluid along two flow paths and premix the concentrate as the mixed beverage is dispensed. In one example, the flow of the selected base fluid, that is flowing at the determined flow rate required to properly form the mixed beverage, is divided such that the base fluid flows along a first flow path and mixes with the concentrate(s) to form the premixed concentrate (as noted above) and a second flow path and through the diffuser 55 (as noted above). The separated flows of the base fluid "recombine" when the premixed concentrate and the base fluid flowing through diffuser mix together to form the mixed beverage. Accordingly, the dispenser uses the base fluid to "pre-dilute" the concentrate(s) when the concentrate(s) and the base fluid are dispensed to form the mixed beverage (e.g., the concentrate(s) are diluted real-time during the dispensing process). Note that the dispenser of the present disclosure dilutes the concentrate(s) without additional diluents.

In one non-limiting example, the dispenser 10 of the present disclosure is configured to form a mixed beverage having a predetermined base fluid-to-concentrate fluid ratio of 20:1 and a predetermined flow rate of 1.05 ounces per second (oz/sec). Based on the predetermined fluid ratio, the predetermined flow rate of the base fluid is 1.00 oz/sec and the predetermined flow rate of the concentrate(s) is 0.05 oz/sec. The dispenser 10 divides the flow of the base fluid (1.00 oz/sec) along two flow paths. For example, a first portion of the base fluid flows along a first flow path to the manifold inlet 32 (FIG. 2) such that the base fluid mixes with the concentrate(s) to form the premixed concentrate (described above). A second portion of the base fluid flows along the second flow path to the body inlet 23 such that the premixed concentrate that flows through the stem 45 (FIG. 2) is further diluted and mixed with additional portion of the base fluid.

The flow rates of the base fluid flowing along the first flow path and the second flow path can vary. In one example, the flow rates of the base fluid flowing along the first flow path and the second flow path sum to the predetermined base fluid flow rate. In one instance, the flow rates of the base fluids in the flow paths are percentages of the predetermined base fluid flow rate. That is, the dispenser divides or splits the base fluid such that the flow rate of the base fluid flowing along the first flow path is a percentage of the predetermined base fluid flow rate (e.g., the flow rate of the base fluid flowing along the first flow path is 25.0% of the predetermined base fluid flow rate). In another example, the flow rate of the base fluids in the flow paths are based on fixed or prescribed flow rates. For instance, the flow rate of the base fluid flowing through the first flow path is at least 0.25 oz/sec regardless of the predetermined base fluid flow rate. For instance, the predetermined base fluid flow rate is 0.35 oz/sec and the flow rate through the first flow path is at least 0.25 oz/sec. In another instance, the predetermined base fluid flow rate is 2.00 oz/sec and the flow rate through the first flow path is at least 0.25 oz/sec.

The dispenser 10 can also include fluid metering devices (not shown) that monitor and/or detect the amounts of the base fluid(s) flowing along the flow paths. For example, the 2.0 ounces of the base fluid are detected flowing along the first flow path.

By dividing the base fluid along two flow paths and dispensing the beverage in real time, the dispensers 10 of the present disclosure have many advantages over known dispensers. For example, the premixed concentrate that is formed (as described above) flows more easily and faster through the dispenser 10 than the concentrates alone. The dispenser dilutes the concentrate(s) as the concentrate(s) and the base fluid are dispensed to form the mixed beverage. The dispenser does not hold or otherwise store the premixed concentrate for use in future mixed beverages. Furthermore, operation and maintenance of the example dispensers 10 is simpler than known dispensers. That is, some known dispensers dilute concentrates with water and then store the diluted concentrate. The diluted concentrate is subsequently dispensed and mixed with the predetermined base fluid flow rate needed to form the mixed beverage. Accordingly, the technician must determine the concentrate content in the diluted concentrate or the water content in the stored diluted concentrate and factor these details into the recipe for the mixed beverage. Failure to factor the water content and the concentrate content of the stored diluted concentrate may results in an improperly formed mixed beverage (e.g., the mixed beverage could be over-diluted). Instead, the dispensers 10 of the present disclosure dilute the concentrates as the mixed beverage is being dispensed ("real time"). Accordingly, the dispensers 10 of the present disclosure prevent the growth of organisms and/or contamination of the concentrates that may otherwise occur if the concentrates are premixed with a diluent or additional amounts of the base fluid and stored for periods of time within the dispenser. Example dispensers 10 of the present disclosure are described herein below.

Referring now to FIG. 3, a schematic diagram of an example dispenser 10 is depicted. The dispenser 10 receives a first base fluid from a first base fluid source 71 via a base fluid orifice 13. The base fluid flows through the orifice 13 as an initial fluid stream and further flows to a dispensing device, such as a first inlet valve 15. When the first inlet valve 15 opens, the first base fluid flows via a first tubing 81 and a manifold tubing 86 along a first flow path FP1 (see arrow FP1) to the manifold inlet 32 (see FIG. 2). In other examples, dispensing device is a pump.

The first tubing 81 is coupled to a second tubing 83, and when the first inlet valve 15 opens, the first base fluid flows via the second tubing 83 along a second flow path FP2 (see arrow FP2) to the body inlet 23. Note that the first base fluid flowing through the first flow path is a first divided fluid stream or portion of the initial fluid stream, and the second base fluid flowing through the second flow path is a second divided fluid stream or portion of the initial fluid stream. Accordingly, the initial fluid stream dispensed by the inlet valve 15 is divided or split and the divided fluid portions or streams of the base fluid flow along the two separate flow paths (see FP1 and FP2) to the manifold inlet 32 and the body inlet 23, respectively. Note that the arrows depicting the flow paths FP1, FP2 are offset from the tubing 81, 83, 86 for clarity. Also note that portions of the flow paths FP1, FP2 may overlap or coincide with each other.

The amount and/or flow rate of the base fluid flowing along the two flow paths is dependent on the interior diameters of the first tubing 81 and the second tubing 83. For example, the interior diameter of the first tubing 81 is less than the interior diameter of the second tubing 83, and thus, the amount or the flow rate of the first base fluid flowing along the first flow path FP1 to the manifold inlet 32 is less than the amount or the flow rate of the first base fluid flowing along the second flow path FP2 to the body inlet 23. In one example, the interior diameter of the first tubing 81 is 0.09375 inches and the interior diameter of the second tubing 83 is 0.25 inches. In certain examples, a check valve 100 is provided to prevent backflow of the first base fluid upstream to the first base fluid source 71.

In certain examples, the interior diameters are set relative to each other such that a desired percentage or amount of the base fluid (or flow rate thereof) flows along the flow paths FP1, FP2 to the manifold inlet 32 and the first body inlet 23, respectively. In one example, the interior diameter of the first tubing 81 is set relative to the interior diameter of the second tubing 83 such that the flow rate of the first base fluid flowing along the second flow path FP2 is 90.0% of the predetermined base fluid flow rate. The flow rate of the first base fluid flowing along the first flow path FP1 is 10.0% the predetermined base fluid flow rate.

Note that in some examples the first base fluid flowing through the first tubing 81 and/or the second tubing 83 creates a fluid pressure (e.g., back pressure) that acts on the first base fluid. The pressure may vary based on different factors, such as the length and/or the interior diameters of the first tubing 81 and/or the second tubing 83. Accordingly, the length and/or the interior diameters of the first tubing 81 and/or the second tubing 83 may directly affect the pressure acting on the first base fluid and thereby affect the flow rate of the first base fluid flowing along the flow paths FP1, FP2. In one instance, the pressure drop or decrease of the base fluid from the first inlet valve 15 to the manifold inlet 32 is less than the pressure drop or decrease from the first inlet valve 15 to the first body inlet 23. As such, the amount or the flow rate of the base fluid flowing along the second flow path FP2 to the first body inlet 23 is greater than the amount or the flow rate of the base fluid flowing along the first flow path FP1 to the manifold inlet 32. Note that the pressure drops of the base fluids flowing along the flow paths FP1, FP2 can be adjusted (e.g., the technician changes the interior diameters of the tubing or the length of the tubing) to thereby adjust the amount or flow rate of the base fluid flowing along the flow paths FP1, FP2. In other examples, the flow rate of the base fluid flowing along the second flow path FP2 to the first body inlet 23 is less than the amount or the flow rate of the base fluid flowing along the first flow path FP1 to the manifold inlet 32. In other examples, the pressure drop or decrease of the base fluid from the first inlet valve 15 to the manifold inlet 32 is greater than the pressure drop or decrease from the first inlet valve 15 to the first body inlet 23.

The example dispenser 10 depicted in FIG. 3 is also configured to receive a second base fluid from a second base fluid source 72 via a second orifice 14. The second base fluid flows through a second dispensing device, such as a second inlet valve 16. Accordingly, the dispenser 10 is capable dispensing one or more base fluids such that mixed beverages containing the first base fluid, the second base fluid, and/or a blend of the first base fluid and the second base fluid can be formed. When the second inlet valve 16 opens, the second base fluid flows via a first tubing 91 and the manifold tubing 86 to the second body inlet 24 along a third flow path FP3 (see arrow FP3). In other examples, the second dispensing device is a pump. Note that the first base fluid and the second base fluid can flow through the manifold tubing 86.

Figure 4:
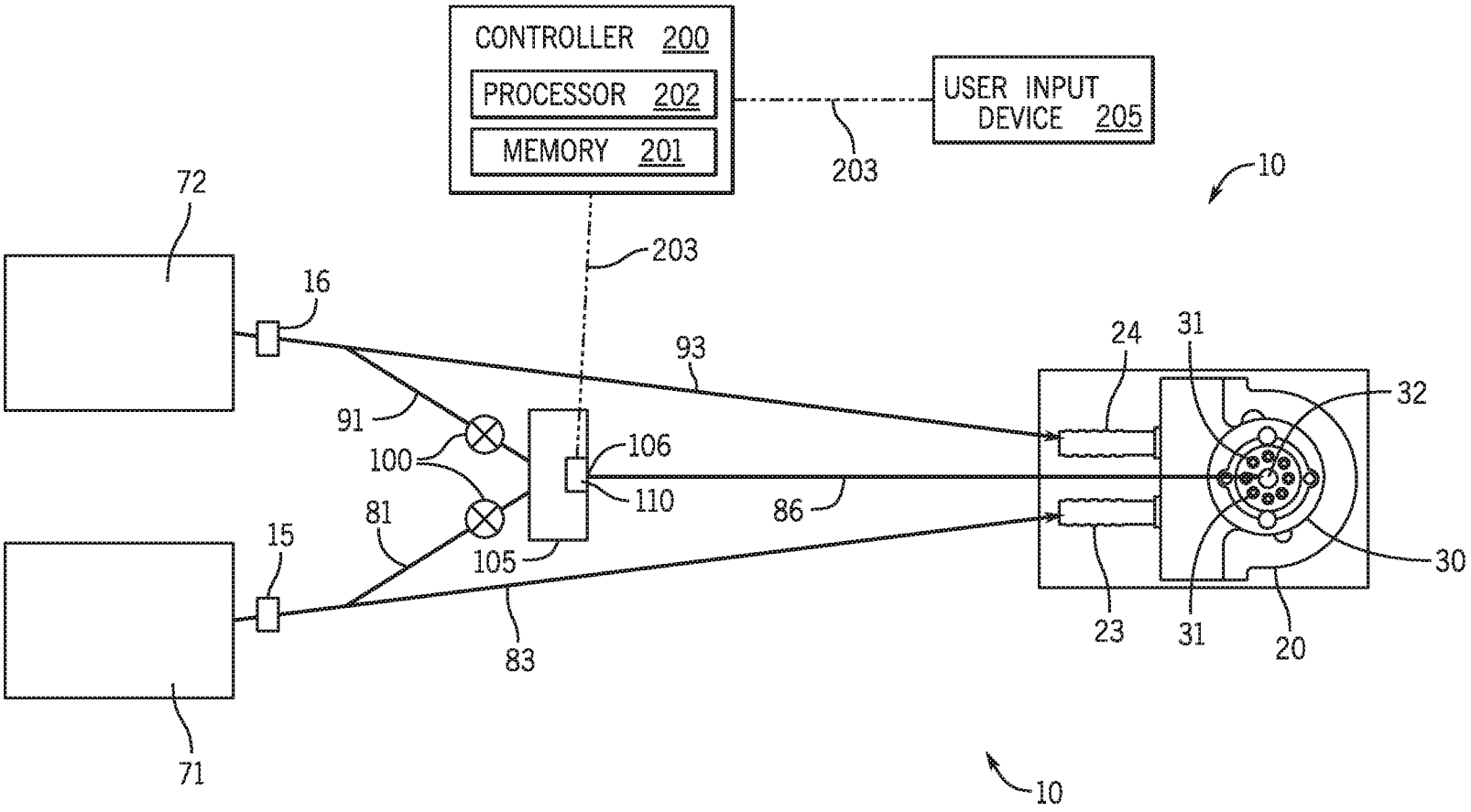
FIG. 4 is another schematic diagram of an example dispenser of the present disclosure.

The first tubing 91 is coupled to a second tubing 93. When the second inlet valve 16 is open, the second base fluid flows via the second tubing 93 along a fourth flow path FP4 (see arrow FP4) to the body inlet 24. Thus, the flow of the second base fluid is also divided (see similar divisions of the first base fluid described above). In certain examples, a check valve 100 is provided to prevent the backflow of the first base fluid upstream to the second base fluid source 72. Note that the arrows depicting the flow paths FP1, FP2 are offset from the tubing 91, 93, 86 for clarity FIG. 4 depicts another example dispenser 10 of the present disclosure. In this example, a block 105 receives the base fluids from the first tubing 81, 91 via inlets (not shown). The block 105 includes internal channels (not shown) and a variable or adjustable orifice device 110 that is configured change the size of an orifice 106 (e.g., 0.125 inch interior diameter, 0.25 inch interior diameter) to thereby vary the amount and/or the flow rate of the first base fluid or the second base fluid that flows through the manifold tubing 86. The orifice 106 is an outlet of the block 105 through which the base fluid(s) flow. In one example, the adjustable orifice device 110 reduces the size of the orifice 106 to thereby decrease the amount or flow rate of the base fluid flowing through the manifold tubing 86 and thus, increase the amount or flow rate of the base fluid flowing through one of the first tubing 81, 91, respectively. A conventional example of an adjustable orifice device is commercially available from SMC Pneumatics (part/model #AS2201F-02-08S).

The adjustable orifice device 110 is controlled by a control system that has a controller 200 with a memory 201 and a processor 202. Specifically, the controller 200 controls the adjustable orifice device 110 to thereby increase or decrease the size of the orifice 106. The controller 200 can also be configured to control other components of the dispenser 10, including but not limited to, an actuator, base fluid pumps (not shown), concentrate pumps (not shown), the inlet valves 15, 16, a user input device 205, and components of a refrigeration system (not shown). The controller 200 is connected to the above-described components via wired or wireless communication links 203.

The controller 200 may send control signals to the adjustable orifice device 110 to thereby change the size of the orifice 106. The desired size of the orifice 106 can be programmed onto the memory 201, and each mixed beverage recipe stored on the memory 201 may include a specific desired size of the orifice 106 (e.g., a carbonated cola mixed beverage recipe includes an orifice size of 0.25 inches, a plain water enriched with vitamin syrup concentrate mixed beverage recipe an orifice size of 0.1825 inch). Optionally, the user input device 205 can be configured to permit a technician or the operator to adjust the size of the orifice 106. For instance, the technician inputs or selects the size of the orifice 106 when installing the dispenser 10. Note that the size of the orifice 106 may also depend on the content or fluid characteristics of the base fluid and/or the concentrate(s), for example the viscosity or the brix value of the fluids.

Optionally, the controller 200 determines the size of the orifice 106 from one or more look-up tables stored on the memory 201. The look-up tables correlate each mixed beverage that can be dispensed from the dispenser 10 to a predetermined orifice size. Thus, when the operator selects a desired mixed beverage via the user input device 205, the controller 200 controls the adjustable orifice device 110 to thereby change the size of the orifice 106 to the predetermined orifice size that corresponds to the selected mixed beverage and/or the flow rate of the base fluid along the first flow path FP1. In another example, algorithms related to the size of the orifice and/or the rate at which the adjustable orifice device 110 changes the orifice 106 are stored on the memory 201.

In one example method of operating the example dispenser 10, the controller 200 receives an input to initiate dispense of the mixed beverage via the user input device 205. The controller 200 then actuates an actuator that controls flow of the base fluid and the concentrate. The actuator as used herein can encompass several devices that collectively control flow of the base fluid and the concentrate. The actuator can include any number of devices of the present disclosure such as the dispensing devices noted above with the respect to the base fluids. The actuator may also include a concentrate dispensing device, such as a concentrate inlet valve 74 (FIG. 3) or a pump, that dispenses and controls flow of the concentrate. The flow of the base fluid is divided along the first flow path FP1 and the second flow path FP2 (see FIG. 3 as described above), and as such, the base fluid flows to and through the body inlet 23 and the manifold inlet 32 and the concentrate flows to and through the concentrate inlet 31. The concentrate then mixes with the base fluid from the manifold inlet 32 and forms a premixed concentrate before the premixed concentrate mixes with the base fluid from the body inlet 23. The fluids dispense via the outlet 63 of the nozzle 60 as the formed mixed beverage. In other examples, the premixed concentrate and the base fluid from the body inlet 23 dispense via the outlet 63 of the nozzle 60 and mix in the receptacle (e.g., cup) to form the mixed beverage. Note that in some examples, the dispenser 10 has a mechanical lever arm (not shown) that when actuated, actuates the actuator, the inlet valves 15, 16, and/or the concentrate inlet valve 74. In this example, actuation of the mechanical lever arm initiates dispense of the base fluid(s) and the concentrate(s) and thereby the mixed beverage. In one example, the actuation of the mechanical lever arm closes an electrical circuit such that the inlet valves 15, 16 and the concentrate inlet valve 74 are actuated. Note that certain example dispensers 10 with a mechanical lever arm may exclude the controller 200.

Figure 5:
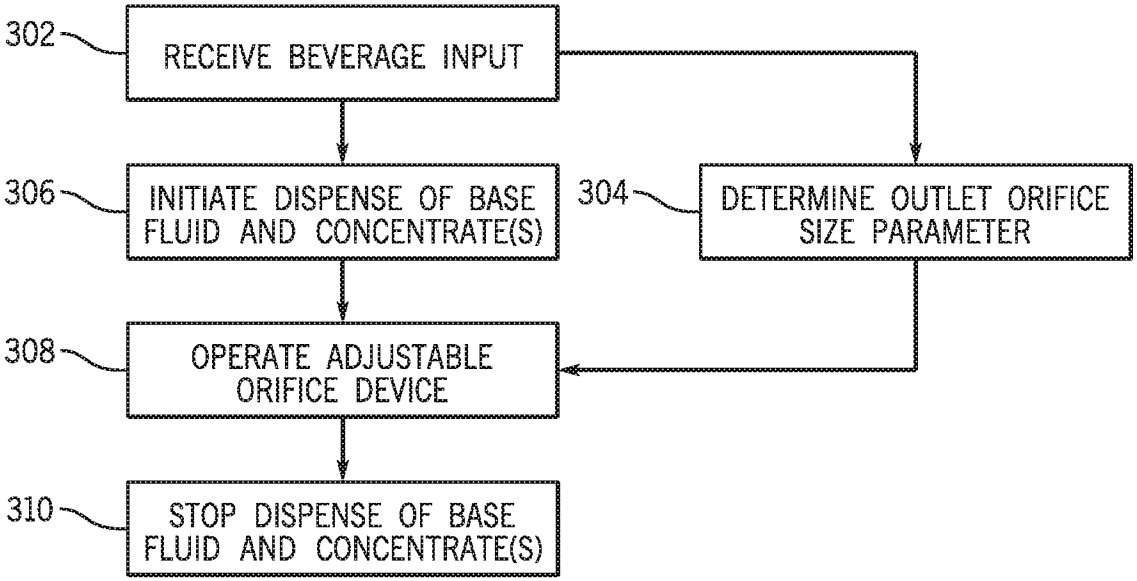
FIG. 5 is an example method for dispensing a mixed beverage from an example dispenser of the present disclosure.

FIG. 5 depicts an example method of operating an example dispenser 10 according to the present disclosure. Note that the components noted in the example method are depicted on FIG. 2-4. At 302 the method begins with the user input device 205 receiving an input from an operator that corresponds to the desired mixed beverage the operator wishes the dispenser 10 to dispense. Based on the input received, the controller 200 controls other components of the dispenser 10, such as pumps (not shown) that pump the concentrate(s) and/or the base fluid to the assembly 20.

At 304 the controller 200 determines, based on the characteristics of the selected mixed beverage (e.g., fluid ratio of the mixed beverage, the type of base fluid and/or concentrate that will mix to form the mixed beverage) and/or one or more lookup tables stored on the memory 201, operational parameters of the orifice 106. The operational parameters may include, but are not limited to, the size of the orifice 106 and the rate at which to change the size of the orifice 106. Based on the determined operational parameters, the controller 200 controls the adjustable orifice device 110.

At 306, the controller 200 controls valves and/or pumps of the dispenser 10 such that the base fluid and the concentrate(s) flow through the dispenser 10. Note that the controller 200 may automatically control the valves and/or the pumps after the input is received via the user input device 205 or the controller 200 may wait to control the components of the dispenser 10 until a predetermine period of time passes, movement of a manual lever arm (not shown) occurs, another input (e.g., a start input) is received via the user input device 205, or a proximity sensor (not shown) detects presence of a cup below the nozzle 60 (FIG. 2). Note that in some examples the concentrate sources 73 (FIG. 3) are pressurized such that when a valve is actuated by the controller 200, the concentrate flows to the concentrate inlet 31. In another example, a pump that is controlled by the controller 200. Similarly, the base fluid sources 71, 72 (FIG. 3) can be pressurized such that when controller 200 receives an input to initiate dispense of the mixed beverage, the controller 200 controls the inlet valves 15, 16 (FIG. 3) which open and dispense the base fluid.

At 308, the controller 200 controls the adjustable orifice device 110 based on the operational parameters of the orifice 106 determined at 304. For example, when the controller 200 opens the inlet valves 15, 16, the controller 200 activates the adjustable orifice device 110 to thereby change the size of the orifice 106 and thereby change the amount or flow rate of the base fluid flowing to the manifold inlet 32 via the manifold tubing 86. Note that in some examples two or more steps noted above at 304, 306, 308 may be combined.

At 310, the controller 200 stops the flow of the base fluids and/or the concentrates (e.g., the controller 200 closes the inlet valves 15, 16). The method returns to 302 when the operator enters an input pertaining to the next desired mixed beverage.

In certain examples, the inlet valves 15, 16 open such that the base fluid flows through the assembly 20 before the concentrate(s) flow through the assembly 20 such that the surfaces of the assembly 20 are "wetted" by the base fluid prior to the introduction of the concentrate into the assembly 20. In certain examples, the base fluid flows through the assembly 20 after the concentrates stop flowing through the assembly 20. This permits additional amounts of the base fluid to flush or clean residual amounts of the concentrate(s) from the assembly 20.

In certain examples, a beverage dispenser includes a source of a base fluid, a source of a concentrate, and an assembly configured to receive and dispense the base fluid and the concentrate together as a mixed beverage having a predetermined base fluid-to-concentrate ratio. An actuator is configured to control flow of the base fluid and the concentrate to the assembly. The assembly is configured to premix a first portion of the base fluid with the concentrate to form a premixed concentrate, and to then dispense a combination of the premixed concentrate and a second portion of the base fluid as the mixed beverage having the predetermined base fluid-to-concentrate ratio. The actuation of the actuator causes an uninterrupted dispense of the base fluid and the concentrate from the source of the base fluid and the source of concentrate to the assembly, and from the assembly to a consumer of the mixed beverage. In certain examples, the dispenser includes a controller configured to actuate the actuator when the controller receives an input to initiate dispense of the mixed beverage. In certain examples, the controller receives the input via a user input device.

In certain examples, the dispenser includes a variable orifice device that changes size of an orifice to thereby control flow rate of the first portion of the base fluid. The controller controls the variable orifice device to thereby change the size of the orifice and flow rate of the first portion of the base fluid. The variable orifice device decreases the size of the orifice to thereby decrease the flow rate of the first portion of the base fluid. In certain examples, the assembly has a nozzle in which the premixed concentrate and the second portion of the base fluid mix to form the mixed beverage. In certain examples, the assembly has a chamber in which the first portion of the base fluid mixes with the concentrate to form the premixed concentrate. In certain examples, the premixed concentrate flows under force of gravity through the chamber. In certain examples, the assembly has a cavity downstream from the chamber and wherein the premixed concentrate and the second portion of the base fluid flow through the cavity. In certain examples, the assembly has a diffuser in the cavity that is configured to diffuse the second portion of the base fluid through the cavity. In certain examples, the assembly has a hollow stem in the cavity through which the premixed concentrate flows and wherein the diffuser encircles the stem.

In certain examples, the first portion of the base fluid flows along a first flow path and the second portion of the base fluid flows along a second flow path to the assembly. In certain examples, flow rate of the first portion of the base fluid flowing along the first flow path and flow rate of the second portion of the base fluid flowing along the second flow path sum to a predetermined base fluid flow rate necessary to form the mixed beverage with the predetermined base fluid-to-concentrate ratio. In certain examples, the flow rate of the first portion of the base fluid is less than the flow rate of the second portion of the base fluid. In certain examples, the base fluid dispensing from the actuator is divided into the first portion of the base fluid that flows to the assembly through a first flow path and the second portion of the base fluid that flows to the assembly through a second flow path. In certain examples, flow rate of the first portion of the base fluid flowing along the first flow path and flow rate of the second portion of the base fluid flowing along the second flow path sum to a predetermined base fluid flow rate necessary to form the mixed beverage with the predetermined base fluid-to-concentrate ratio.

In certain examples, a first tubing defines the first flow path along which the first portion of the base fluid flows to the assembly and a second tubing intersects the first tubing and defines the second flow path along which the second portion of the base fluid flows to the assembly. In certain examples, the first tubing has a first interior diameter and the second tubing has a second interior diameter that is greater than the first interior diameter such that the flow rate of the base fluid flowing through the first tubing is less than the flow rate of the base fluid flowing through the second tubing.

In certain examples, a method of dispensing a mixed beverage having a predetermined base fluid-to-concentrate ratio includes dispensing an uninterrupted flow of a base fluid and a concentrate to an assembly, which in real-time during dispense of the mixed beverage to the consumer, premixes a first portion of a base fluid with the concentrate to form a premixed concentrate, and then mixes a second portion of the base fluid with the premixed concentrate to form the mixed beverage having the predetermined base fluid-to-concentrate ratio. In certain examples, the method includes receiving, with a controller, an input to initiate dispense of the mixed beverage via a user input device such that the controller actuates the actuator.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A beverage dispenser comprising:

a source of a base fluid;

a source of a concentrate;

an assembly configured to receive and dispense the base fluid and the concentrate together as a mixed beverage having a predetermined base fluid-to-concentrate ratio, the assembly having a chamber, a cavity downstream from the chamber, a diffuser in the cavity and comprising a bore, and a hollow stem that extends through the bore in the diffuser; and an actuator configured to control flow of the base fluid and the concentrate to the assembly;

wherein the assembly is configured to premix a first portion of the base fluid with the concentrate in the chamber to form a premixed concentrate, and to then dispense a combination of the premixed concentrate and a second portion of the base fluid as the mixed beverage having the predetermined base fluid-to-concentrate ratio;

wherein the diffuser is configured to diffuse the second portion of the base fluid through the cavity before the second portion of the base fluid mixes with the premixed concentrate in the cavity; and wherein actuation of the actuator causes an uninterrupted dispense of the base fluid and the concentrate from the source of the base fluid and the source of concentrate to the assembly, respectively, and from the assembly to a consumer of the mixed beverage.

2. The beverage dispenser according to claim 1, further comprising a controller configured to actuate the actuator when the controller receives an input to initiate dispense of the mixed beverage.

3. The beverage dispenser according to claim 2, wherein the controller receives the input via a user input device.

4. The beverage dispenser according to claim 1, further comprising:

a variable orifice device that changes size of an orifice to thereby control flow rate of the first portion of the base fluid; and a controller that controls the variable orifice device to thereby change the size of the orifice and flow rate of the first portion of the base fluid.

5. The beverage dispenser according to claim 4, wherein the variable orifice device decreases the size of the orifice to thereby decrease the flow rate of the first portion of the base fluid.

6. The beverage dispenser according to claim 1, wherein the assembly has a nozzle in which the premixed concentrate and the second portion of the base fluid are mixed to form the mixed beverage.

7. The beverage dispenser according to claim 1, wherein the premixed concentrate flows under force of gravity through the chamber.

8. The beverage dispenser according to claim 1, wherein the first portion of the base fluid flows along a first flow path and the second portion of the base fluid flows along a second flow path to the assembly.

9. The beverage dispenser according to claim 8, wherein flow rate of the first portion of the base fluid flowing along the first flow path and flow rate of the second portion of the base fluid flowing along the second flow path sum to a predetermined base fluid flow rate necessary to form the mixed beverage with the predetermined base fluid-to-concentrate ratio.

10. The beverage dispenser according to claim 9, wherein the flow rate of the first portion of the base fluid is less than the flow rate of the second portion of the base fluid.

11. The beverage dispenser according to claim 1, wherein the base fluid dispensed by the actuator is divided into the first portion of the base fluid that flows to the assembly through a first flow path and the second portion of the base fluid that flows to the assembly through a second flow path.

12. The beverage dispenser according to claim 11, wherein flow rate of the first portion of the base fluid flowing along the first flow path and flow rate of the second portion of the base fluid flowing along the second flow path sum to a predetermined base fluid flow rate necessary to form the mixed beverage with the predetermined base fluid-to-concentrate ratio.

13. The beverage dispenser according to claim 11, wherein a first tubing defines the first flow path along which the first portion of the base fluid flows to the assembly and a second tubing intersects the first tubing and defines the second flow path along which the second portion of the base fluid flows to the assembly.

14. The beverage dispenser according to claim 13, wherein the first tubing has a first interior diameter and the second tubing has a second interior diameter that is greater than the first interior diameter such that the flow rate of the first portion of the base fluid flowing through the first tubing is less than the flow rate of the second portion of the base fluid flowing through the second tubing.

15. The beverage dispenser according to claim 1, wherein the assembly extends along an axis, and wherein the diffuser is configured to radially outwardly deflect the second portion of the base fluid.

16. A beverage dispenser comprising:

a source of a base fluid;

a source of a concentrate;

an assembly configured to receive and dispense the base fluid and the concentrate together as a mixed beverage having a predetermined base fluid-to-concentrate ratio, the assembly comprising a chamber, a cavity downstream from the chamber, a hollow stem in the cavity and a diffuser in the cavity encircling the hollow stem; and an actuator configured to control flow of the base fluid and the concentrate to the assembly;

wherein the assembly is configured to premix a first portion of the base fluid with the concentrate in the chamber to form a premixed concentrate, and to then dispense a combination of the premixed concentrate and a second portion of the base fluid as the mixed beverage having the predetermined base fluid-to-concentrate ratio;

wherein the premixed concentrate flows through the hollow stem and the second portion of the base fluid is diffused through the diffuser before the second portion of the base fluid mixes with the premixed concentrate in the cavity; and wherein actuation of the actuator causes an uninterrupted dispense of the base fluid and the concentrate from the source of the base fluid and the source of concentrate to the assembly, respectively, and from the assembly to a consumer of the mixed beverage.

17. The beverage dispenser according to claim 16, wherein the premixed concentrate flows under force of gravity through the chamber.

18. The beverage dispenser according to claim 16, wherein the assembly extends along an axis, and wherein the diffuser is configured to radially outwardly deflect the second portion of the base fluid.

19. The beverage dispenser according to claim 16, wherein the first portion of the base fluid flows along a first flow path to the assembly, the first flow path defined by a first tubing, and the second portion of the base fluid flows along a second flow path to the assembly, the second flow path defined by a second tubing that intersects the first tubing.

* * * * *